US010150608B2

(12) United States Patent
Witcher

(10) Patent No.: US 10,150,608 B2
(45) Date of Patent: Dec. 11, 2018

(54) FLOWABLE MATERIAL DISPENSER

(71) Applicant: Steven D. Witcher, Petaluma, CA (US)

(72) Inventor: Steven D. Witcher, Petaluma, CA (US)

( * ) Notice: Subject to any disclaimer, the term of this patent is extended or adjusted under 35 U.S.C. 154(b) by 0 days.

(21) Appl. No.: 15/542,912

(22) PCT Filed: Jan. 14, 2016

(86) PCT No.: PCT/US2016/013487
§ 371 (c)(1),
(2) Date: Jul. 11, 2017

(87) PCT Pub. No.: WO2016/115402
PCT Pub. Date: Jul. 21, 2016

(65) Prior Publication Data

US 2018/0009595 A1 Jan. 11, 2018

Related U.S. Application Data

(60) Provisional application No. 62/103,525, filed on Jan. 14, 2015.

(51) Int. Cl.
*B65D 83/00* (2006.01)
*B05C 17/005* (2006.01)
*B05C 17/01* (2006.01)

(52) U.S. Cl.
CPC .... *B65D 83/0066* (2013.01); *B05C 17/00583* (2013.01); *B05C 17/0133* (2013.01); *B05C 17/0103* (2013.01)

(58) Field of Classification Search
CPC ..... B65D 83/0066; B65D 83/0011; A65B 11/0024; B05C 17/0116; B05C 17/012; B05C 17/0133
See application file for complete search history.

(56) References Cited

U.S. PATENT DOCUMENTS 1,491,860 A * 4/1924 Holden ..... B65D 83/0066 222/104
1,923,974 A 8/1933 Hand
1,959,365 A * 5/1934 Jeffreys ..... B65D 35/28 222/104
2,218,290 A * 10/1940 Moricich ..... A46B 11/0024 222/104
2,234,857 A * 3/1941 Thorn ..... B65D 83/0066 222/104
2,333,320 A * 11/1943 Lautmann ..... B65D 83/0066 222/104

(Continued)

*Primary Examiner* — Paul R Durand
*Assistant Examiner* — Randall Gruby
(74) *Attorney, Agent, or Firm* — Craig M. Stainbrook; Stainbrook & Stainbrook, LLP

(57) ABSTRACT

A flowable material dispenser including a barrel defining a cylindrical interior volume for holding a flexible material bag containing a flowable material. A nozzle is attached to the first end of the barrel for discharging the flowable material through a nozzle hole; and a closure is disposed on the second end. A center nut disposed on the closure holds a threaded drive rod threadably and rotatably inserted in the center nut. The drive rod includes an inner end and an outer end. Drive structure for imparting rotational forces to the drive rod moves the drive rod reciprocally and axially within the cylindrical interior volume of the barrel to twist and wring out flowable material contained within the flexible material bag.

20 Claims, 18 Drawing Sheets

(56) References Cited

U.S. PATENT DOCUMENTS

| | | | | | |
|---|---|---|---|---|---|
| 2,421,711 | A * | 6/1947 | Moots | B05C 17/00586 | 222/327 |
| 2,502,918 | A * | 4/1950 | Beresford | B65D 83/0066 | 206/277 |
| 3,407,968 | A * | 10/1968 | Fiquet | B65D 35/28 | 222/104 |
| 3,774,816 | A * | 11/1973 | Bratton | B01F 13/002 | 222/135 |
| 3,870,198 | A | 3/1975 | Cohen | | |
| 4,560,352 | A * | 12/1985 | Neumeister | A61C 9/0026 | 222/390 |
| 5,429,273 | A | 7/1995 | King et al. | | |
| 5,450,988 | A * | 9/1995 | Jerdee | B05C 17/0103 | 222/333 |
| 5,755,362 | A | 5/1998 | Rodriguez, Jr. et al. | | |
| 5,819,980 | A * | 10/1998 | Hill | B65D 83/0011 | 220/719 |
| 9,314,814 | B2 * | 4/2016 | Yildirim | B05C 17/00583 | |
| 2009/0321478 | A1 * | 12/2009 | Juteau | B65D 83/0011 | 222/390 |
| 2014/0339257 | A1 | 11/2014 | Ben-Air | | |
| 2017/0101254 | A1 * | 4/2017 | Tomesch | B65D 83/0005 | |

* cited by examiner

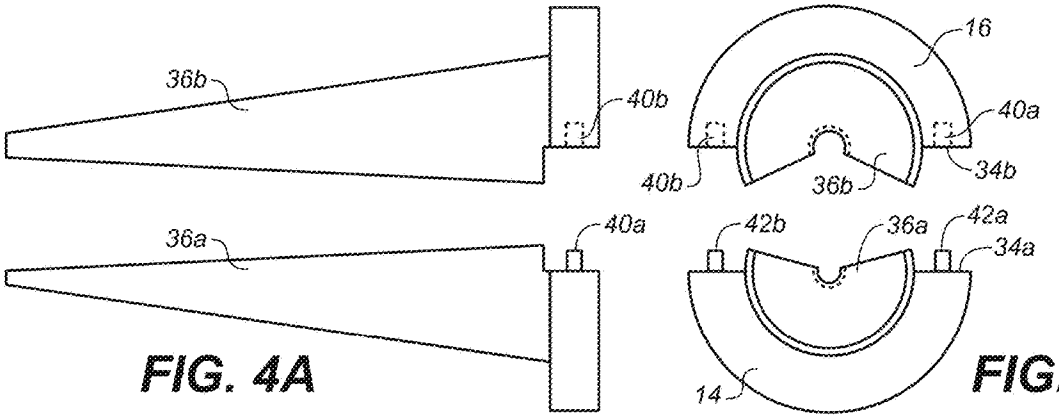
FIG. 4A
FIG. 4B
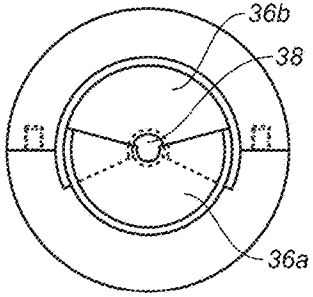
FIG. 4C
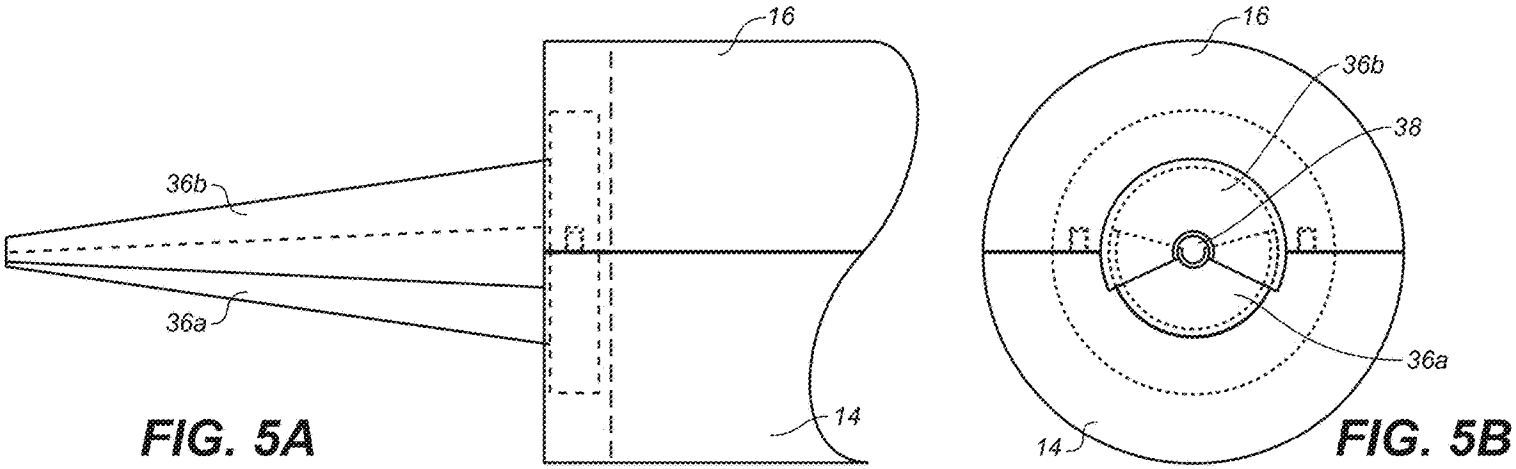
FIG. 5A
FIG. 5B

FLOWABLE MATERIAL DISPENSER

BACKGROUND OF THE INVENTION

Technical Field

The present invention relates generally to applicators for flowable materials, and more particularly to caulking and grout guns, and still more particularly to a screw-driven wringer-type flowable material dispenser.

Background Art

In the tuckpointing, caulking, grouting, and mortaring trades, a common method for dispensing the sealant or joint filler is to load a prepackaged cylinder of material into a caulking gun and to discharge the material into joints or onto surfaces using a plunger reciprocally actuated using the handle of the gun. These guns are well known and generally employ a piston driven by a manual pawl-and-ratchet lever incorporated into the tool handle. A consistent problem with piston-expelled, cartridge-packaged materials (aside from the expense and materials), is seal failure between the plunger cup and the interior sides of the cartridge. They are thus entirely unsuited for use in the application of two-part epoxy materials or materials that must be mixed on-site, in the field.

There is thus a need for a tool enabling the application of two-part epoxy materials in lengthwise sectional bags to be mixed in a static nozzle or in a burst pack configuration mixed in the field. The present invention provides such a tool and therefore expands its potential application beyond conventional grouts, adhesives, and sealants.

DISCLOSURE OF INVENTION

The present invention is a grout gun employing, as a principal operational feature, a traveling forked (or pronged) paddle disposed within a barrel and used to create a twisting motion to wring materials from a pre-packaged polyethylene bag or cylinder. The flowable materials discharged by the inventive gun dispenser are expelled and controlled by the rotation of the forked paddle in connection with tightly controlled reciprocal travel, axially, down the cylindrical gun barrel, in coordination with the shortening bag cylinder as it is twisted to expel material and effectively "wring out" the pre-packaged bag. Use of the material bag leaves the gun completely free of working materials and ready for easy removal and replacement by the next filled cylinder bag.

Bag materials and dimensions can be adjusted for the particular flowable material type to be expelled, but the principle of operation remains the same for delivery over a wide range of flowable materials. In addition to cementitious grouts and masonry cements, the flowable materials that can be discharged using the inventive apparatus may include energetically modified cements, adhesives, sealants, reactive adhesives (e.g., two-part epoxies, which can be mixed from a burst pack or forced through a static mixing nozzle), non-reactive adhesives (e.g., drying adhesives), and the like.

The inventive apparatus is significantly larger than conventional caulking guns, (e.g., 4"×16") and weighs more, as well, though lightweight construction may reduce weight differences significantly. It can employ either a manual drive screw to twist and impel the forked paddle forward or a motor to drive the drive screw. This "drill-type" design uses a motorized drill (powered via electric cord or battery) and positions the pistol grip trigger handle rearward at a balanced distance from the gun cylinder. Gearing for the motor is relatively low (10 to 30 rpm) for paddle speed, thus providing a highly controllable material discharge and making the drill application-specific. Drill handle placement provides excellent balance to the gun for easy manipulation of the gun nozzle and placement of materials, and preferably allows for approximately three inches of travel in the forked paddle with a strong rotation at 10-30 rpm. The drill motor includes forward and reverse switches.

The above-described motorized configuration enables the power assembly to be secured in place with the manual handle for alternative (or emergency) use, and thus provides a convenient tripod-type configuration for stable loading and resting of the gun. Additionally with the use of a large final gear wheel, the need for a specialty low speed motor may be obviated.

The slow rotation of the drive screw can be achieved by a gear reduction system for a conventional drill or a variable speed motor with fine control over drill speed. Preferably the power comprises a detachable power assembly with a handle trigger that snaps into place as a cradle at the back of the gun tube. When placed on ground, the cradle assembly supports the gun at a slightly downward angle for loading. In an embodiment, the motor assembly includes a parallel threaded rod at the motor axis with a threaded collar to rotate and travel axially. The motor drives a toothed belt that rotates a fixed collar on the threaded rod of the forked paddle.

The grout gun tube may use a single size for different material applications. A fixed tube diameter of 3¾ inches and a barrel length of 16 inches provides means to handle both a 60 ounce, (108 cubic inch), and an 80 ounce, (144 cubic inch), material packaging. A smaller gun can be employed for material bag packs containing 32 to 48 ounces of material or smaller sizes of 12 to 24 ounces. The drive handle for manual operation is the basic drive means for driving all units, but a quick-connect, pistol grip and hand crank can also be provided for medium and smaller versions.

In making a comparison between the equipment and processes of cartridge materials and those of packaged bagged materials of all types, it will be appreciated that there are considerable cost savings realized by using the inventive grout gun, and cost reduction is therefore a significant advantage in using the material bag dispensing gun of the present invention.

In an embodiment, the grout gun employs a three-pronged forked paddle, which is most advantageous for material bags that require added length for mixing a powdered product with a liquid additive for activation and fluidity. The forked paddle allows a user to slip the folded empty end of the bag straight down onto the prongs to be rotated, and further enables pulling any excess slack out of the working end of the bag in helping to control how the bag expels the materials to be placed. For packaged, flowable materials that do not need mixing, the wringer end of the bag can include a broadened end seal, (optionally with pre-punched holes), for clamping to the end of the threaded rod. The pre-punched holes may be fitted over studs on the clamp to positively secure the correct positioning of the bag as it is wrung out. For some bags and products, a hook may be sufficient.

An additional advantage resides in the fact that materials in polyethylene bags can easily be sterilized and then sealed with a more uniform and secure seal. This adds to the shelf life for some products and may make some industrial foodstuffs suitable for this type of packaging and use.

Another principle advantage of the grout gun of the present invention is that it expels substantially all of the flowable material in the material bag. As the bag is wrung out and material expelled through the nozzle, there is only a very small amount of material that remains trapped in the folds or creases of the twisted and emptied bag. There is slightly more material left at the nozzle end of the bag that may not always be expelled by the wringing motion of the drive screw, but the amount is insubstantial in relative terms. Even this small amount can be expelled by hand relatively easily after removing the bag from the gun.

The screw drive used in the grout gun has course threads, approximately seven threads per inch, which provides for one inch of travel, (to accommodate for the shortening bag as it is twisted), for every seven complete rotations of the forked paddle. A ⅝ inch diameter, trapezoidal threaded rod in both six threads per inch and eight threads per inch may also be employed. When trapezoidal rods are used, a matching hex nut is mounted on the gun for journaling. As a drive screw for the 60 to 80 ounce grout gun, a ⅝"×8 thread rod and nut with a minimum of 3" of allowable travel is preferred. When the grout bag is placed properly in the gun, with excess air volume released prior to securing the end of the bag in the forked paddle, there is little need for more than sixteen to eighteen revolutions to expel and place all of the bag materials. A variable, forward, rotational speed of the battery powered motor requires no more than 10 to 12 rpm, while reverse operation can be substantially faster.

As noted, in an embodiment, a three-pronged, forked paddle is employed, as it has proven especially efficient and adaptable. However, a simpler, single-prong design useful for products that do not require field mixing, (i.e., sealants and adhesives), can be provided, the strongest being one in which the sealed end of the bag is folded over and double-sealed to create an empty loop in the end of the bag. This flat, empty loop, containing no product to be dispensed, is then slipped over the prong closest to the screw shaft and entwined between the first and second prongs. This results in the bag end following the same path through the forked paddle as is followed by the much longer bag end for grout products requiring field mixing. This provides a much stronger means of securing the end of the bag than a clamp or single stud design. It provides consistency in the packaging materials while also providing maximum strength at the bag end, but it principally provides consistency in the method of use and gun design.

Other novel features characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty that characterize the invention are pointed out with particularity in the claims annexed to and forming part of this disclosure. The invention resides not in any one of these features taken alone, but rather in the particular combination of all of its structures for the functions specified.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4A is a side view in elevation showing barrel nose details with the nose in an open configuration, this barrel shape adapted for use with flowable material bags having a flexible nose portion;

FIG. 4B is a front (outer) end view in elevation of the nose of FIG. 4A;

FIG. 4C is the same view showing the nose in a close configuration;

FIG. 5A is a side view in elevation showing the nose incorporated into the barrel portion of the dispenser in a closed configuration;

FIG. 5B is a front (outer) end view in elevation of the nose as seen in FIG. 5A;

BEST MODE FOR CARRYING OUT THE INVENTION

Figure 1:
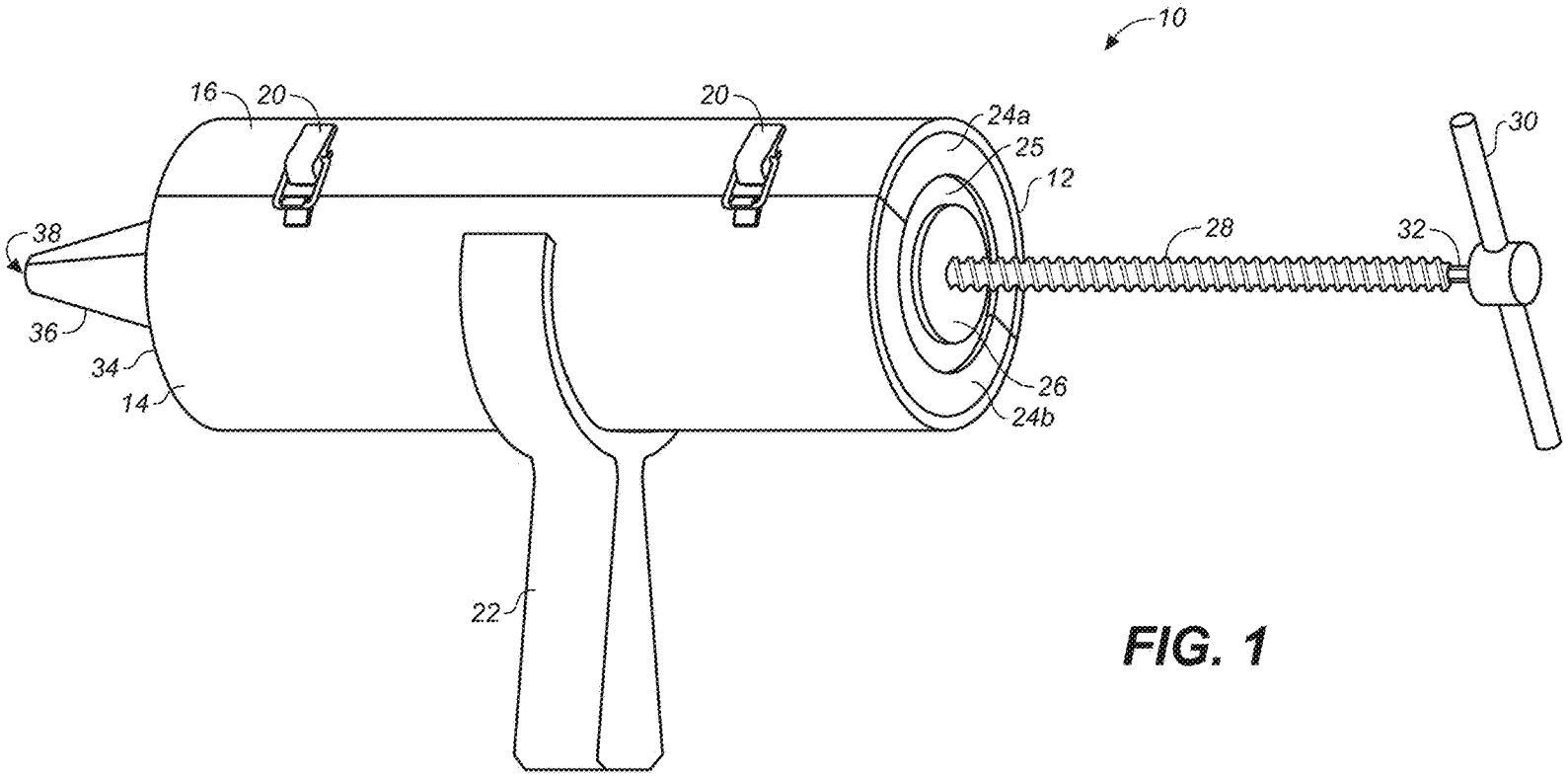
FIG. 1 is a perspective view of a first preferred embodiment of the flowable material dispenser of the present invention, namely, a manually operated embodiment.
Figure 2:
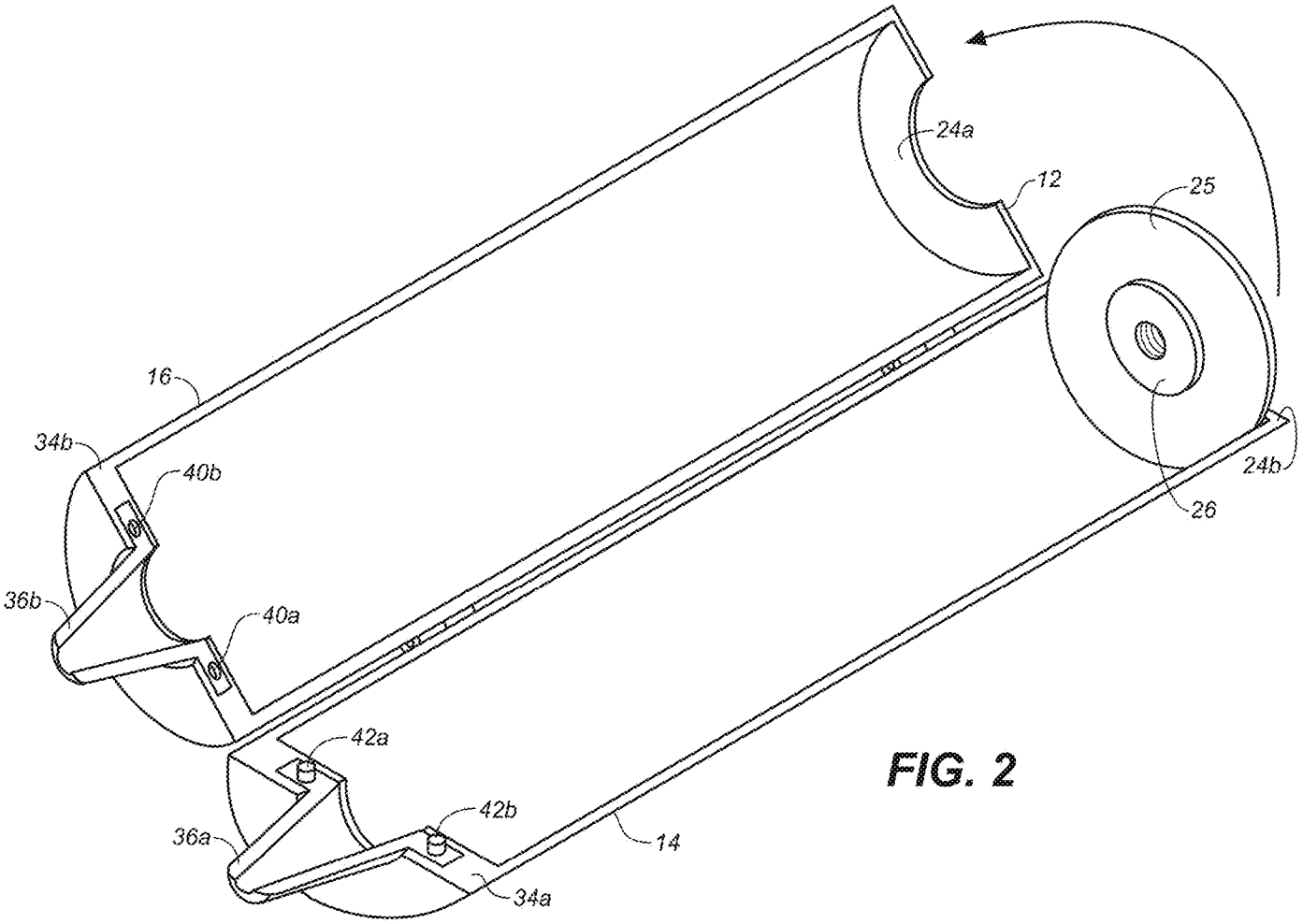
FIG. 2 is an upper front perspective end view showing the barrel of the dispenser opened for placement of a flowable material bag.
Figure 3B:
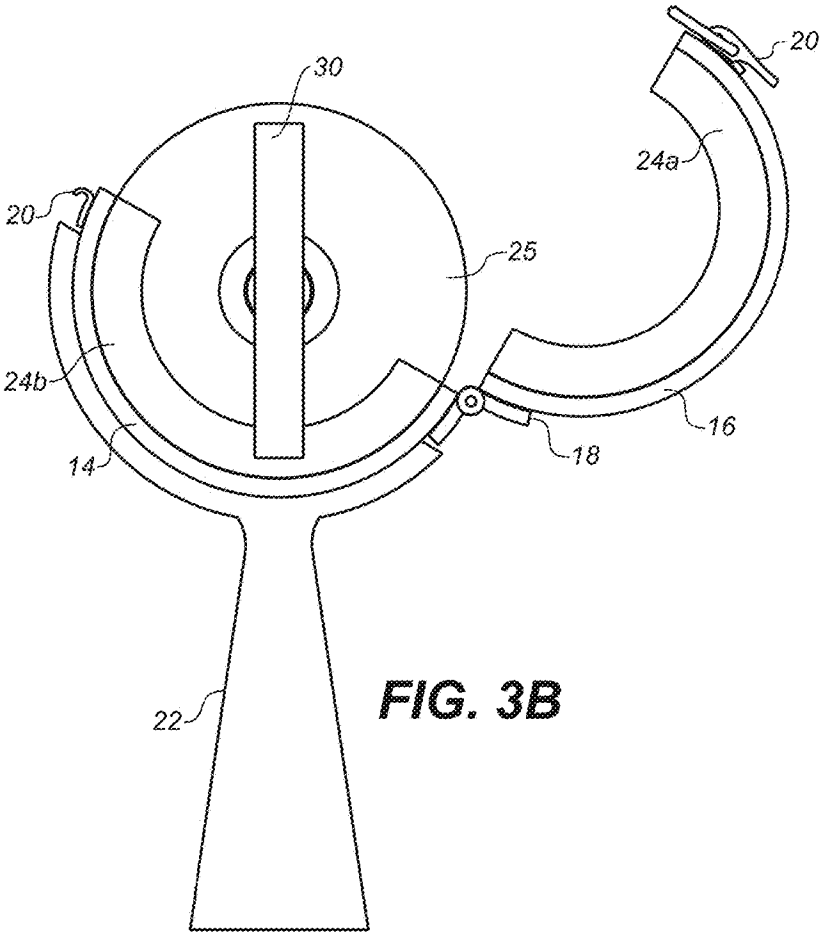
FIG. 3B is the same view showing the barrel of the dispenser opened for installation or removal of a material bag.
Figure 3A:
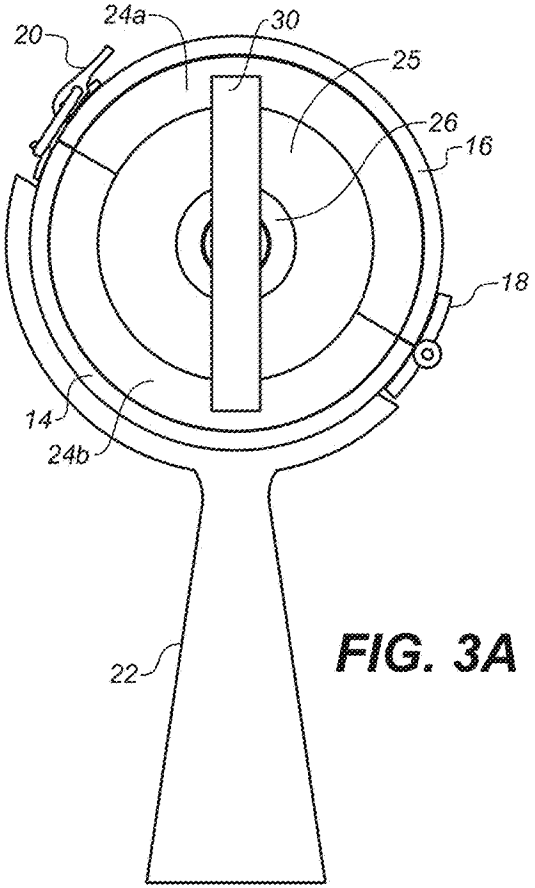
FIG. 3A is a rear end view in elevation showing the dispenser apparatus with a handle attached to the drive rod, this view showing the dispenser in a closed configuration.

Referring to FIGS. 1 through 15B, wherein like reference numerals refer to like components in the various views, there is illustrated therein a new and improved flowable material dispenser. FIGS. 1-7F illustrate an embodiment of the inventive apparatus, in this instance a manually operated iteration, which is generally denominated 10 herein. The dispenser includes a cylindrical barrel body 12 having a base portion 14 and an arcuate hinged panel door 16 pivotally coupled to the base portion with hinges 18. The door closure is secured by latches 20.

A handle 22 may be disposed on the underside of the base portion, though the size of the dispenser will determine the need for such structure. The handle is thus optional, as its precise positioning, when added. It might be disposed generally under the barrel, so as to provide an assist principally in lifting and holding the barrel upright when bearing a heavy material load, or it may be disposed on the side of the barrel, principally for the purpose of facilitating controlled of the barrel when dispensing material.

At its rear, the barrel is closed by hemispherical circular drive screw plates 24*a*, 24*b*, capturing a circular plate 25 which has a center nut 26 into which a threaded drive rod 28 is threadably and rotatably inserted. In the manually operated embodiment, the drive screw has a handle 30 at its outer end 32. Details of how the drive plate is secured within the barrel body are not included and need not be discussed, as there are myriad ways in which to make such an end closure, all well within the knowledge of those with ordinary skill in the art. Essentially, however, the drive screw plate must not rotate when the drive rod is turned.

The barrel next includes a barrel nose or nozzle end 34 having a split nozzle 36 comprising semiconical halves 36*a*, 36*b*, which close with barrel closure to form a taper that terminates in a nozzle hole (or opening) 38 into and through which the nozzle of a flowable material bag is inserted during use (described below). Opposing hole elements 40*a*, 40*b*, and pin elements 42*a*, 42*b*, are disposed on the interior surface of the barrel end halves 34*a*, 34*b* to secure fins on the nozzle portion of the flowable material bag (also described below).

Looking next to the rear end of the dispenser, and referring now specifically to FIGS. 7G-7L, it is seen that the drive rod 28 couples to a slotted plate 44 integral with or attached to its inner end 46. The slotted plate preferably includes at least three prongs or tines 48, spaced apart with gaps so as so enable the tail portion of a material bag to be threaded through and woven around them in a serpentine-like configuration.

This directs our attention next to FIGS. 6A-6H showing the flowable material bag 60 especially adapted for use with the above-described dispenser.

Figure 6A:
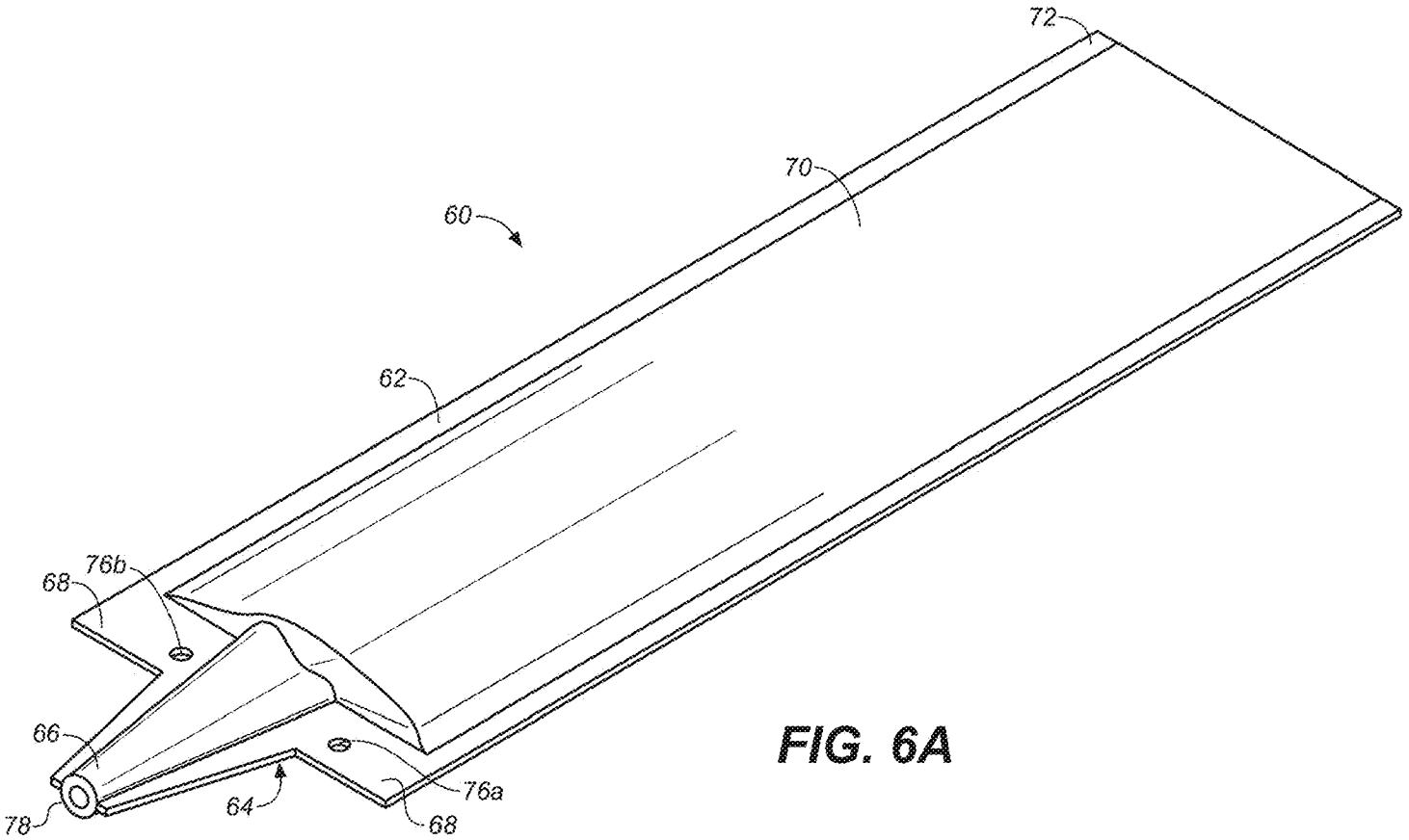
FIG. 6A is an upper front perspective view of an empty flowable material bag shown independently from the dispenser for which it is adapted, this bag provided with a flexible nose portion.
Figure 6B:
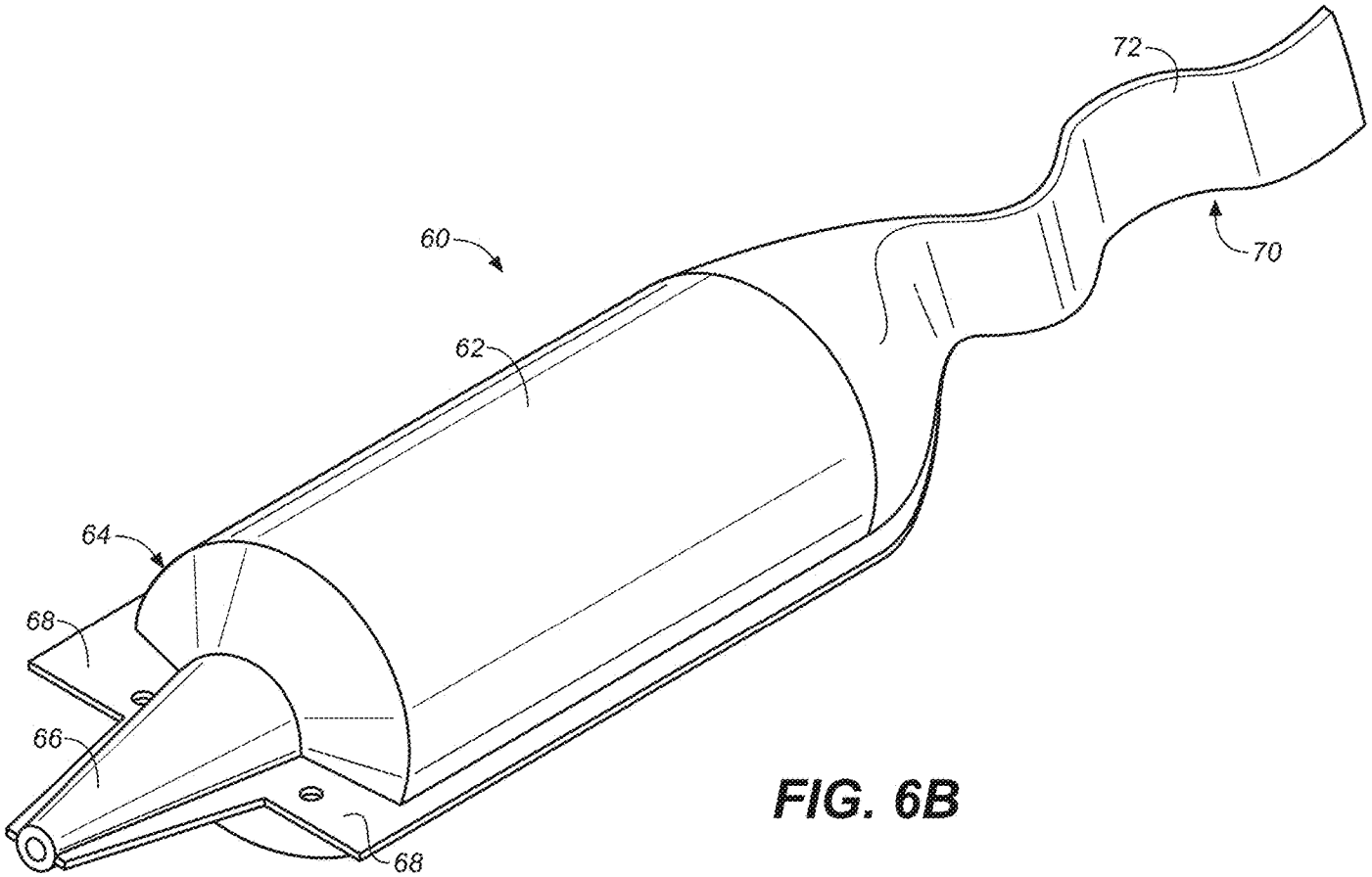
FIG. 6B is the same view showing the same bag filled at its front (material containing) portion with material and its rear portion in an empty "tail" configuration prepared for installation in the flowable material dispenser.
Figure 6D:
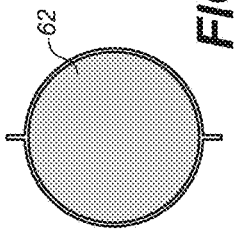
FIG. 6D is a cross-sectional end view taken along section lines 6D-6D of FIG. 6C.
Figure 6F:
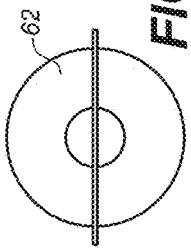
FIG. 6F is a front end view in elevation thereof.
Figure 6C:
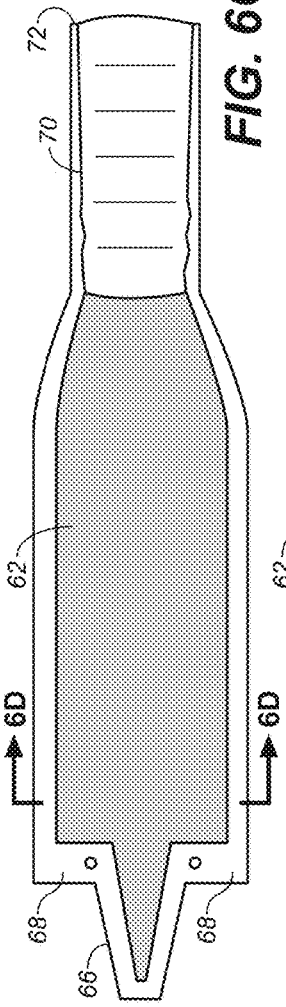
FIG. 6C is a highly schematic side view in elevation of the material bag of FIGS. 6A and 6B.
Figure 6E:
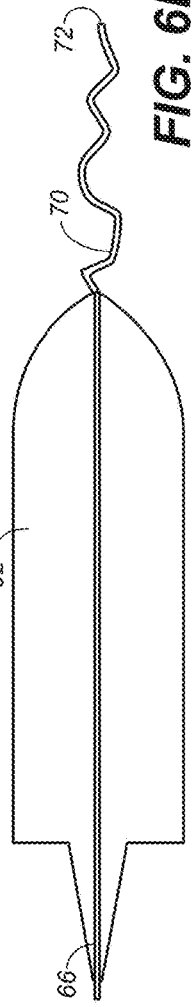
FIG. 6E is a top plan view of the material bag of FIGS. 6B-6D.
Figure 6G:
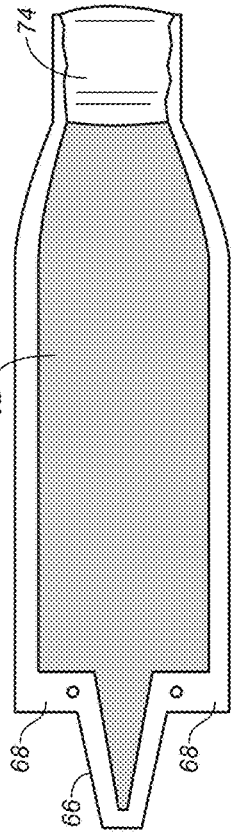
FIG. 6G is a side view in elevation showing the tail portion of the flowable material bag folded back for installation in the dispenser portion of the present invention.
Figure 6H:
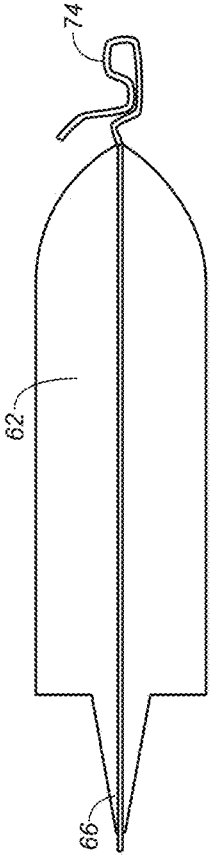
FIG. 6H is a top plan view thereof.
Figure 7A:
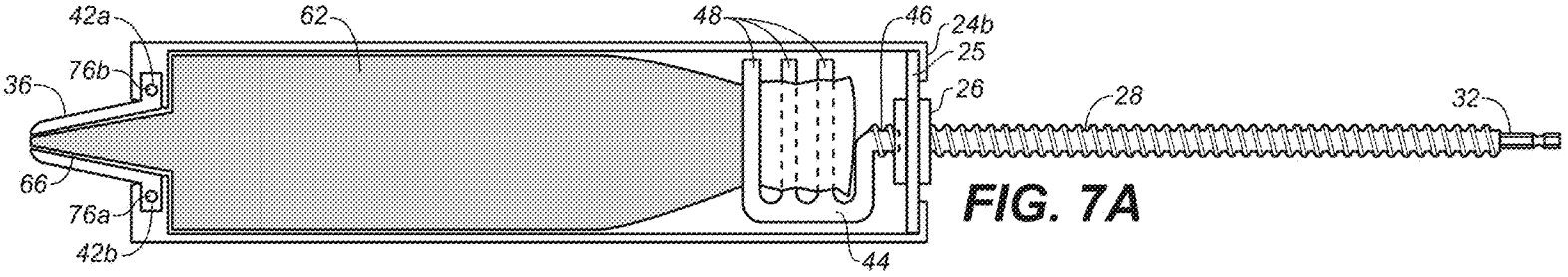
FIG. 7A is a plan view in elevation showing a filled flowable material bag (as seen in FIGS. 6B-6H) installed in the dispenser of the present invention with half of the dispenser barrel removed so as to enable viewing of the wringing operation in the dispenser.
Figure 7B:
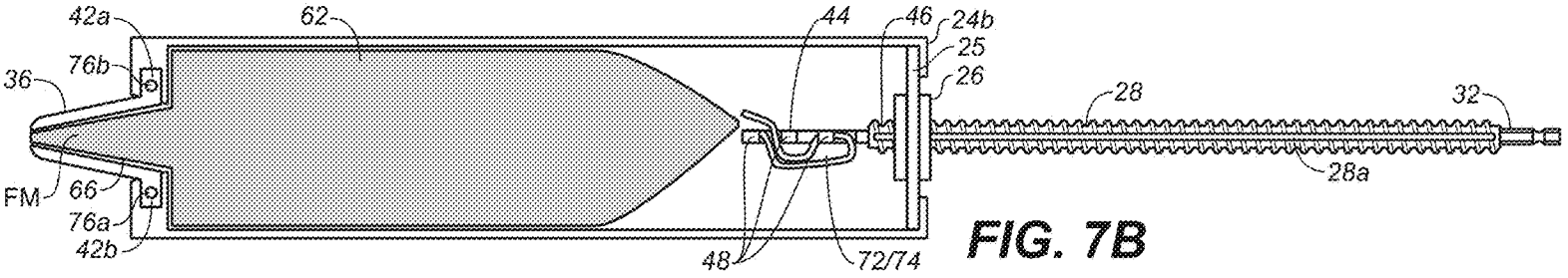
FIG. 7B shows the same bag with the drive screw and slotted plate turned 90 degrees.
Figure 7C:
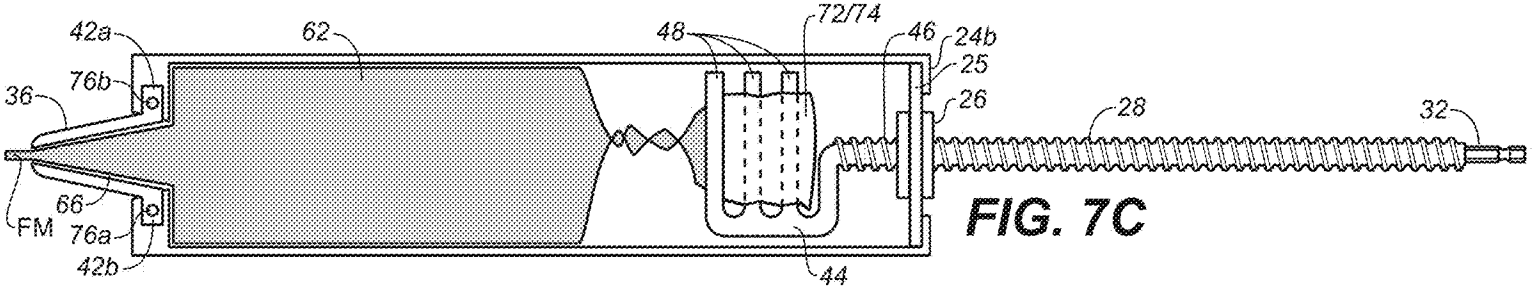
FIG. 7C shows the bag with the drive screw and slotted plate turned several full rotations so as to wring out a portion of the flowable material.
Figure 7D:
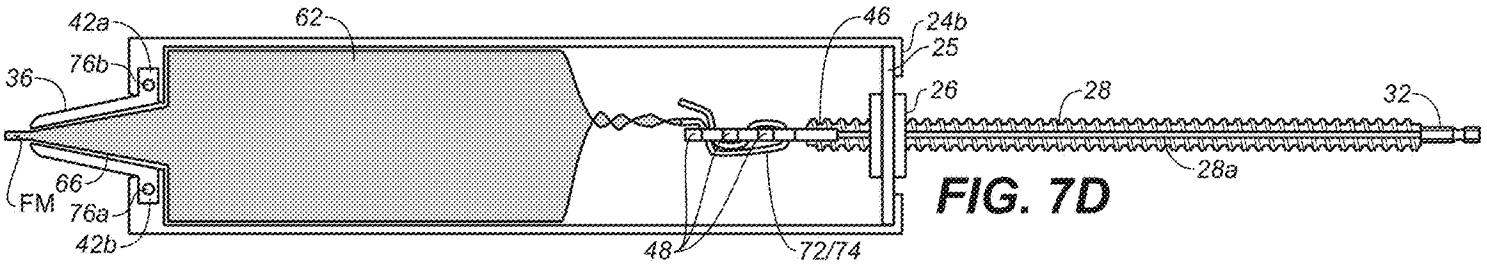
FIG. 7D shows the material bag further wrung out.
Figure 7E:
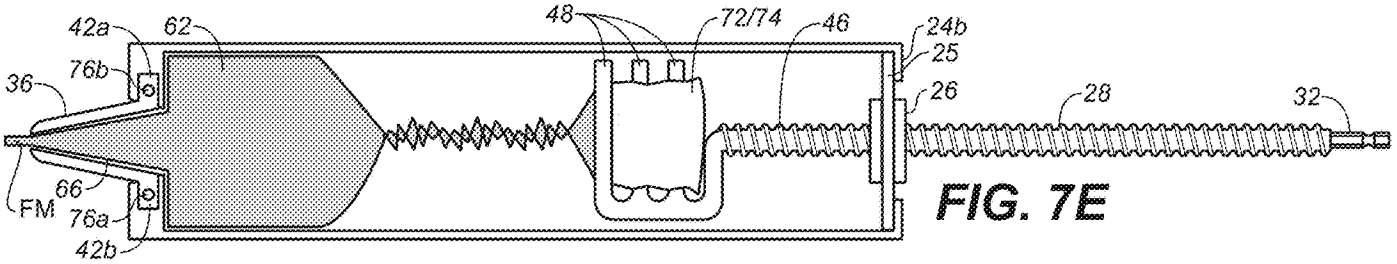
FIG. 7E shows the material bag still further wrung out.
Figure 7F:
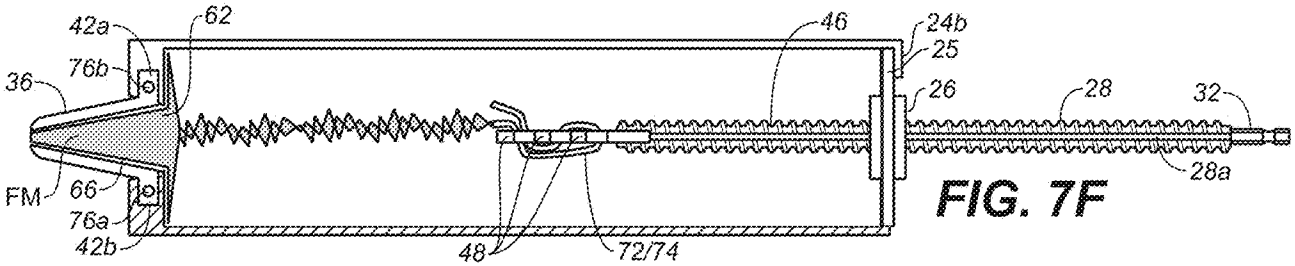
FIG. 7F shows the material bag substantially emptied by the wringing out operation of the dispenser.
Figure 8:
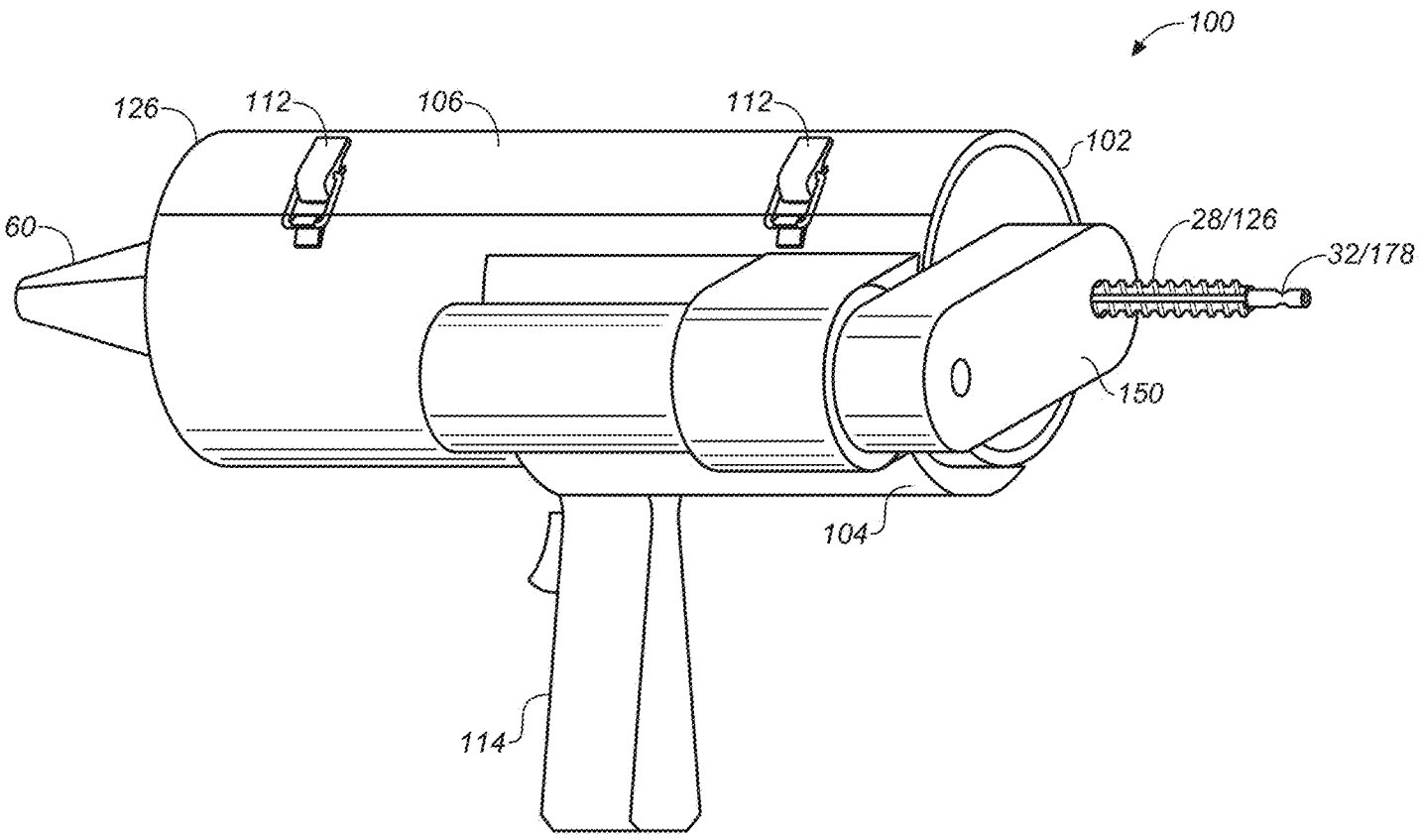
FIG. 8 is slight lower rear side perspective view of a second preferred embodiment of the inventive apparatus, this embodiment including structures for a powered mechanical driver.
Figure 9B:
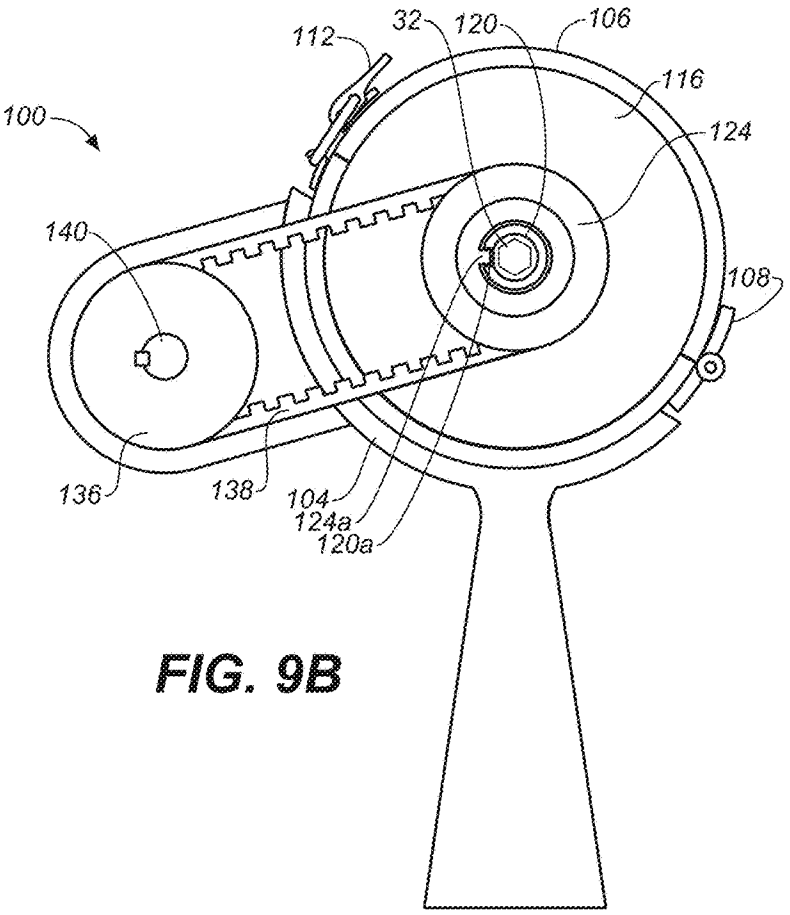
FIG. 9B is the same view showing the driver gear cover removed.
Figure 9A:
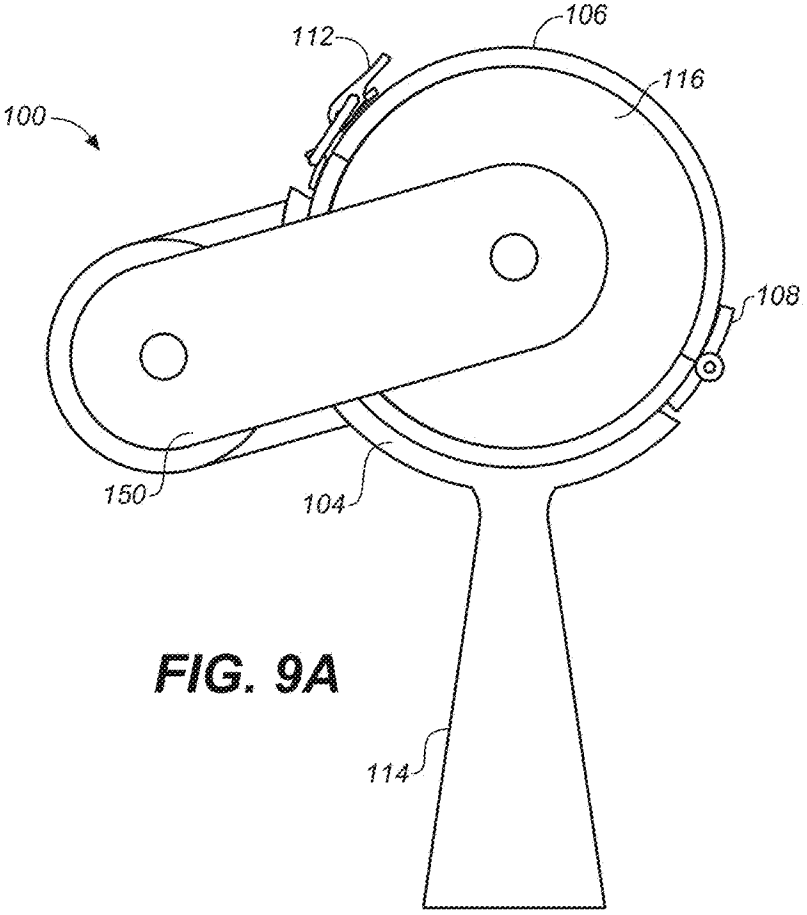
FIG. 9A is a rear end view thereof.
Figure 10A:
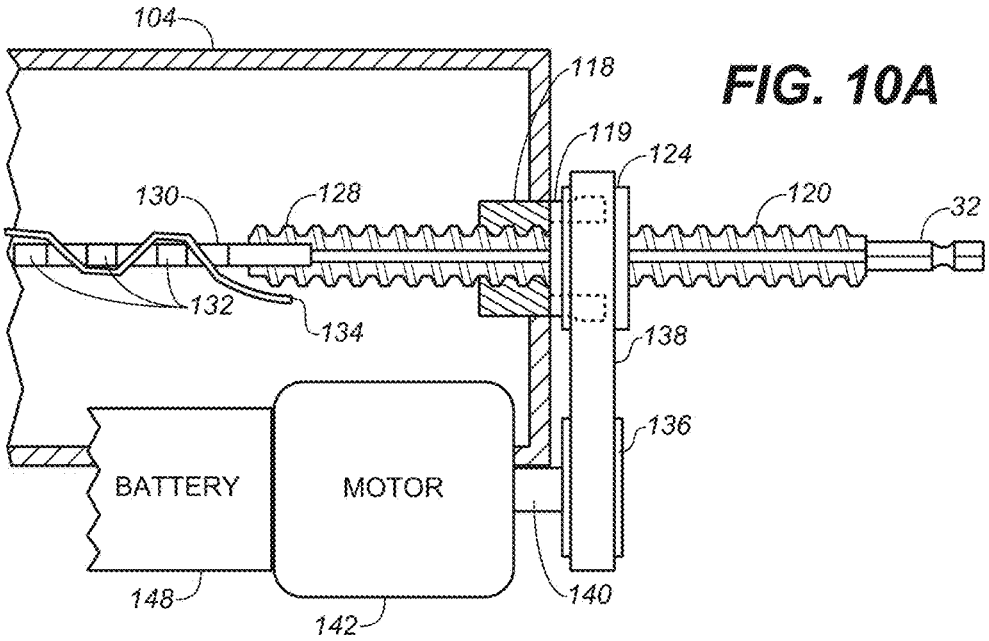
FIG. 10A is a cross-sectional side view in elevation showing details of the drive unit for the powered mechanical driver with the flowable material bag prepared for wringing out.
Figure 10B:
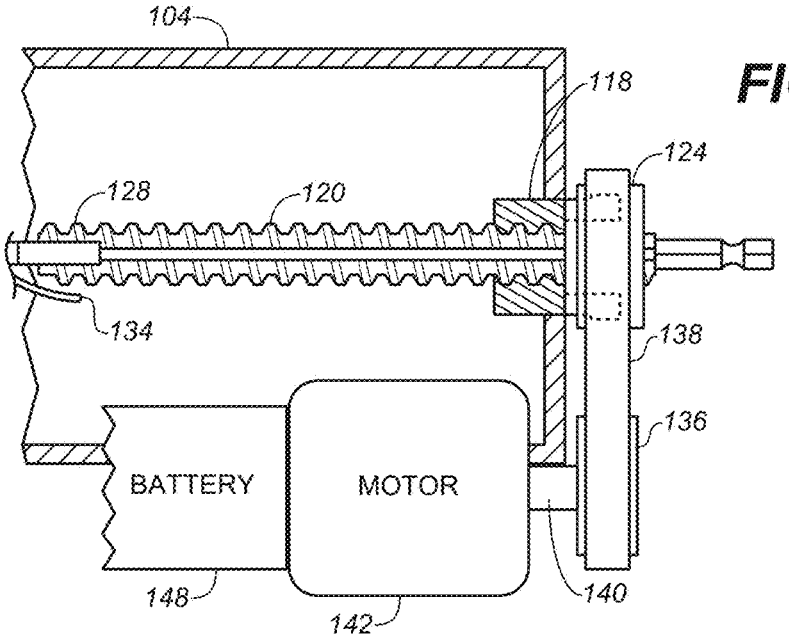
FIG. 10B is the same view showing the driver after having turned many revolutions and having thus generally wrung out the flowable material bag.
Figure 11:
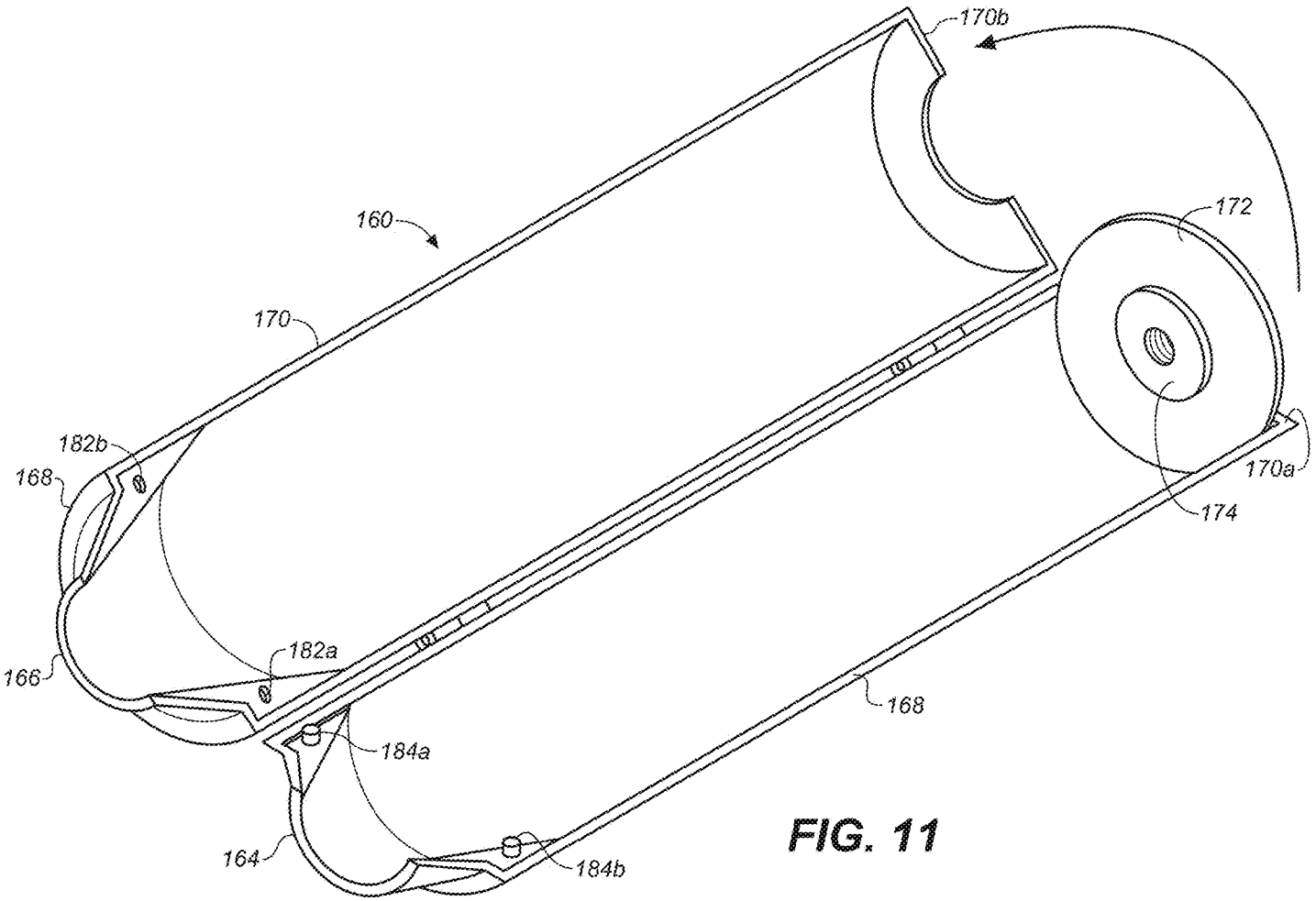
FIG. 11 is an upper front perspective view showing an alternative barrel design adapted for use with a material flow bag having a rigid conical nose portion.

The flowable material bag 60, seen in an empty condition in FIG. 6A, includes a flexible sleeve 62 formed at its front end 64 to converge into a flexible or semi-rigid funnel form cone 66 that has two perforated fins 68 that cooperate with the slots 40*a*, 40*b*, and pins 42*a*, 42*b* in the dispenser barrel end 34*a*, 34*b*, to connect the bag 60 to the barrel interior and to secure the conical tip portion 66 of the bag so that it does not spin with the material bag as it is twisted during the wringing-out material discharge process (described in detail, below). That is, when the bag is installed in the gun, the closure of the barrel halves 14, 16 and the approximation of end portions 34*a*, 34*b*, secure the conical end with fins such that as the flexible bag is wrung out, the conical end remains fixed and stationary in relation to the barrel. The tip of the cone is cut when dispensing is desired so as to create the opening through which flowable material FM can be discharged.

In another embodiment, the funnel form cone of the material bag may be relatively rigid in comparison to the material bag generally. This is described in detail in relation to FIGS. 12-14F.

The rear portion 70 of the flexible sleeve 62 is flattened and welded into a sealed flexible tail 72. As seen in FIGS. 6B-6H, this tail is interlaced in a serpentine pattern around the tines and through the slots in the slotted plate 44. Other weaving patterns may be usefully employed to secured the tail in the plate, including, preferably, a pattern in a terminal loop 74 (FIGS. 6G-6H) is created by twisting the tail and the loop is disposed over one of the end tines.

As will be appreciated, the barrel may be fabricated from any of a number of sufficient sturdy and durable materials, including several aluminum or other metal alloys, as well as hard plastics and composites. Material selection is therefore not limiting. The drive rod and slotted plate are preferably stainless steel.

Likewise, the flowable material bag may be fabricated from a number of flexible and sturdy materials, though a polyethylene sheet (e.g., 4 mil) is a preferred material and provides the strength and flexibility needed for optimal material containment and discharge under twisting forces.

In use the material bag may be provided to a user pre-packaged, as sold by a construction materials and hardware supplier; or empty and suitable for containing a mixed material which is mixed in the field for filling the bag filled on-site. In such a case, the flexible tail is formed from an excess sleeve segment (the "tail") 72 defined by a portion of the sleeve that remains unfilled, and the tail thus remains unsealed. It is therefore formed simply by flattening the tail, and the interlacing and looping process described above is used to secure the tail to the slotted plate as well as to prevent material from flowing back and out from the tail end.

Figure 12:
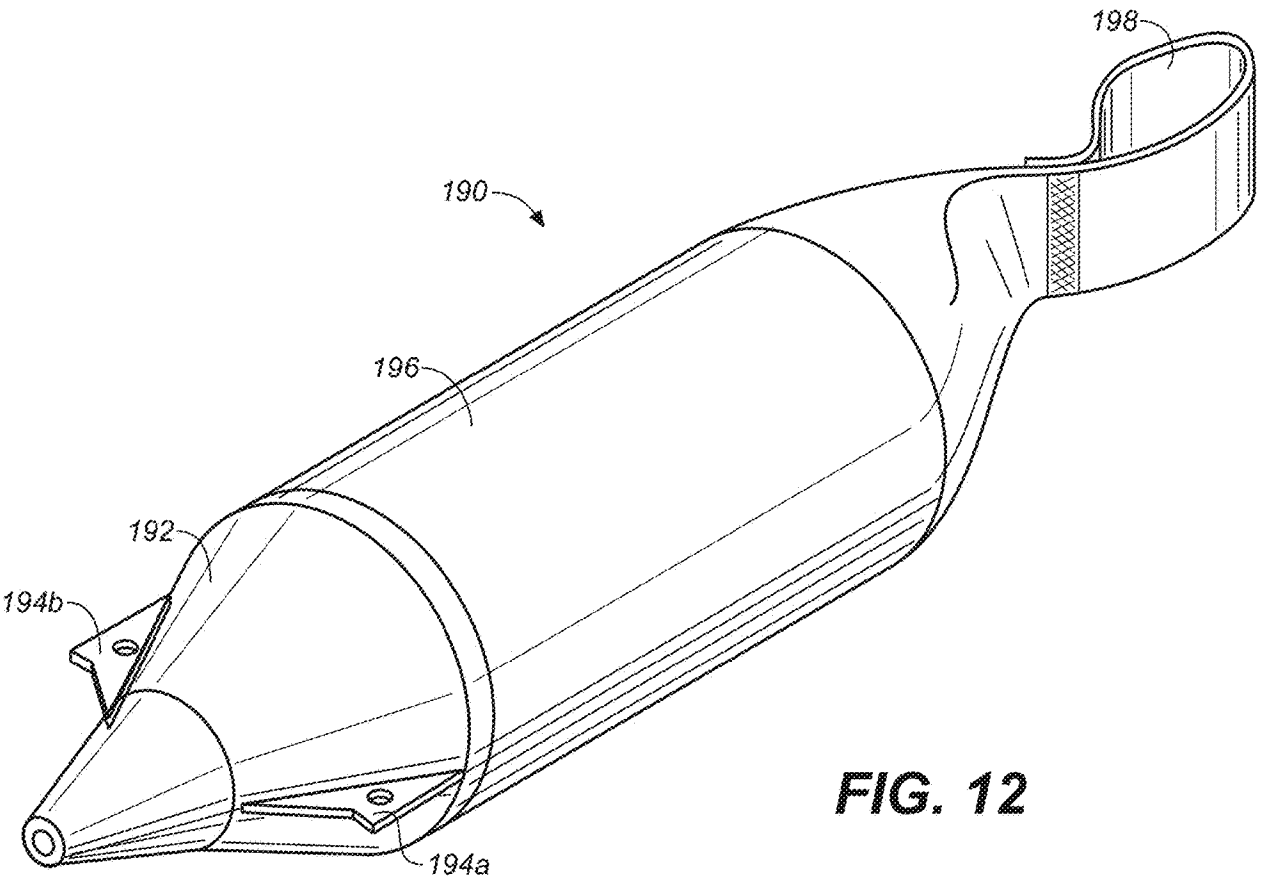
FIG. 12 is an upper front perspective view showing an alternative barrel design for use in the barrel of FIG. 11, this bag having a welded tail formed into a loop.

A filled flowable material bag is shown in FIGS. 6B-6H. The barrel door 16 is opened and the bag is placed lengthwise in the open barrel with holes 76*a*, 76*b* in the fins 68 of the conical end 66 inserted onto the pins 42*a*, 42*b*, in the barrel nose 34 portion. The tail 72 of the bag 60 is then interlaced in and on the slotted plate 44 to provide a sufficiently secure connection between the slotted plate and the bag such that the bag does not detach when the tail is twisted to wring out the material. Accordingly, the bag is secured at its cone end on the barrel nose. In an alternative form, when the compound is supplied in a pre-mixed and pre-packaged form (for instance, as shown in FIG. 12, discussed below), a sonic weld may be employed to close the tail end and to form a loop in the tail. This loop is then disposed around the slotted plate tines in essentially the same manner as the loose tail is interwoven.

Once the bag is installed, the tip 78 of the conical end is cut to provide an opening for the discharge of the flowable material FM, and the handle 30 is then twisted to begin application of the flowable material through what is, in effect, a "wringing out" process wherein the available outlet for the flowable material is limited to the nozzle opening alone. The process is continued until the bag is entirely emptied or the job completed, as shown in FIGS. 7A-7F.

As will be appreciated, sleeve materials and overall bag dimensions may be adapted for the particular flowable material to be applied. Even so, the principle of operation remains the same over a wide range of flowable material products. The dispenser is ideally suited for cementitious grouts and masonry cements, but it is equally well suited for use in applying energetically modified cements, adhesives, sealants, reactive adhesives (e.g., two-part epoxies, which can be mixed from a burst pack or forced through a static mixing nozzle), non-reactive adhesives (e.g., drying adhesives), and the like. Because of its principal uses, the inventive apparatus may generally be considered and classified as a "grout gun."

The dispensing apparatus is significantly larger than conventional caulking guns, (e.g., 4" dia.×16" length) and it will generally weigh more as well. The grout gun barrel may use a single size for different material applications. For instance, a fixed tube diameter of 3¾" with a barrel length of 16" provides a volume sufficient for both a 60 ounce (108 cubic inch) bag of material, and an 80 ounce, (14 cubic inch) material packaging. A smaller gun can be employed for material bag packs containing 32 to 48 ounces or smaller sizes down to 12 to 24 ounces.

As earlier noted, the inventive dispenser can employ either a manual drive screw to twist and impel the forked paddle forward, or it may use an electric motor to drive the drive screw.

Referring next to FIGS. 8-10B, the drill-type electric motor design is another embodiment of the present invention and is denominated 100 herein. This embodiment preferably uses a motorized drill powered by a cord plugged into a wall socket by a battery. As with the manually powered embodiment, this motorized embodiment includes a cylindrical barrel body 102 having a base portion 104 and an arcuate hinged panel door 106 pivotally coupled to the base portion with hinges 108. Again, the door closure is secured by latches 112. A pistol-grip trigger handle 114 is disposed on the underside of the base portion at a balance point.

The barrel is closed at its rear with a circular drive screw plate 116, having a central nut 118 with a threaded center hole into which a threaded drive rod 120 is threadably and rotatably inserted. Rod 120 is rotated by motor 142 through a drive train linkage inside cover 150.

Motor 140 has a shaft 142 that is fixedly coupled to drive pulley 138. Drive pulley 138 moves drive belt 138 that in turn causes driven pulley 124 to rotate. Pulley 124 is rotatably attached to a bushing 119 that is fixidly attached to plate 116. Shaft 120 is sized to freely move in the hollow center of bushing 119. There is a keyway 120*a* that runs the entire length of the threaded rod 120. There is a projection 124*a* on a portion of the inner diameter 123 of driven pulley 124 that engages keyway 120*a* and causes threaded rod 120 to be slidably coupled to driven pulley 124. This arrangement allows threaded rod 120 to be rotatably advanced through end plate 116 while the motor and drive train maintain their position relative to the end plate.

The inner end 128 of the drive rod 120 couples to a slotted plate 130 which has spaced-apart prongs or tines 132 for interleaving the tail portion 134 of a flowable material bag. The outer end 32 of the drive rod 120 is capable of working with a standard powered tool driver should the motor 142 fail.

Gearing for the motor is relatively low (10 to 30 rpm) for slotted plate speed, and may be varied for the particular material and the particular application or use. Handle placement may be adjusted longitudinally to provide balance to the gun while materials is discharged from the material bag during the approximate three inches of travel in the slotted plate. The drill motor includes forward and reverse operation to performing the material discharge and to be reset to loading configuration. It is powered by a battery 148 or power from an electrical outlet.

The motor, power supply, drive and driven pulleys, and drive belt may all be covered with a single shroud or belt and pulley cover 150 which may be removed for easy maintenance, repair, and adjustment.

It will be appreciated that the screw drive used in the grout gun has relatively course threads, preferably approximately seven threads per inch. This allows for one inch of travel forward toward the nozzle end of the barrel for every seven complete rotations of the slotted plate. This compensates for the shortening material bag as it is twisted. Smaller and larger rods and thread pitches may, of course, be employed. It has been determined from testing that when the flowable material bag is placed in the gun barrel and the excess air removed prior to securing the tail end of the bag in the slotted plate, the material is entirely expelled in sixteen to eighteen revolutions.

FIG. 11 and FIGS. 14A-14F show an alternative embodiment 160 of the gun barrel portion of the dispensing apparatus. In this embodiment, the taper at the front of the barrel when the barrel is closed extends as a truncated nose portion 162 having a larger opening to accommodate a larger portion of a relatively rigid conical end for an embodiment of the flowable material bag, shown in FIG. 12.

Preferably the nose portion includes two tapering halves, 164, 166, one each extending from the nose end 168 of the barrel. As in the manually powered embodiment, at its rear, the barrel is closed by hemispherical circular drive screw plates 170*a*, 170*b*, capturing a circular plate 172 which has a center nut 174 into which a threaded drive rod 176 is threadably and rotatably inserted. In a manually operated embodiment, the drive screw (drive rod) has a handle at its outer end 178. A slotted plate 180 is disposed on the proximal (inner) end of the drive rod, and the front portion of the barrel includes hole and pin elements 182*a*, 182*b*, and 184*a*, 184*b*, respectively, to secure flowable material bags as described above, for operation which proceeds, also as described above.

Figure 13A:
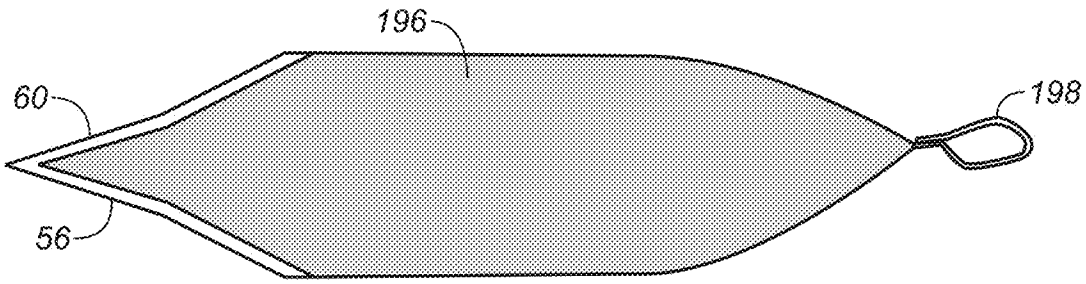
FIG. 13A is a highly schematic top plan view of the material bag of FIG. 12.
Figure 13B:
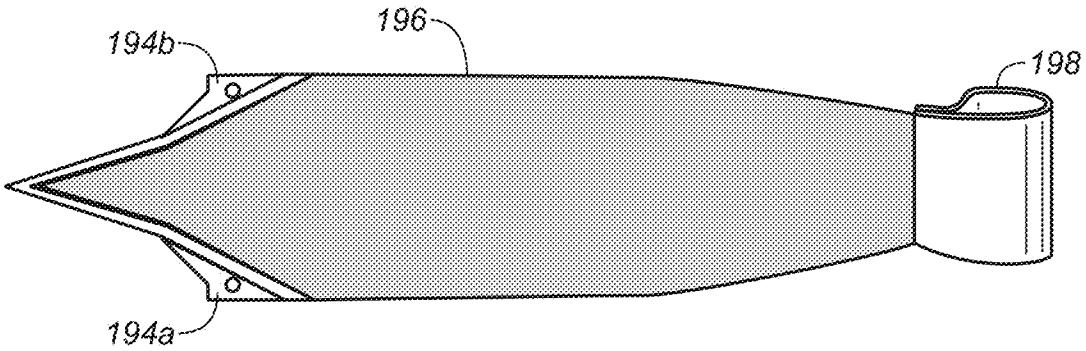
FIG. 13B is a side view in elevation thereof.

FIGS. 12-13B show an alternative flowable material bag 190, this embodiment having a rigid or semi-rigid conical nose 192 for use in the barrel described in connection with FIG. 11 and FIGS. 14A-14F. Otherwise, the bag is structurally and functionally similar to the entirely flexible bag, and includes fins 194*a*, 194*b* for placement onto the pin and hole elements 182*a*, 182*b*, 184*a*, 184*b* of barrel 160, a flowable material-containing portion 196, and a tail portion 198, which is preferably welded into a loop so as to make this embodiment particularly well suited for pre-mixed materials.

Figure 14A:
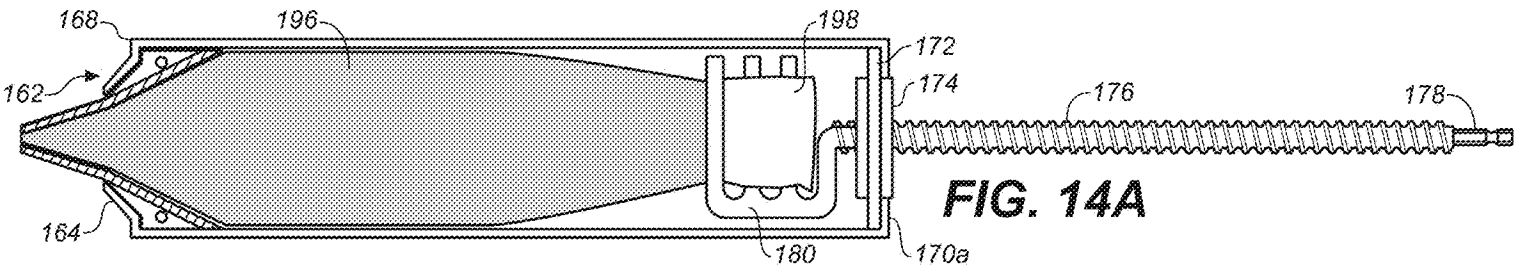
FIG. 14A is a side view in elevation showing the material bag (as seen in FIGS. 12-13B) installed in the dispenser of the present invention with half of the dispenser barrel removed so as to enable viewing of the wringing operation in the dispenser.
Figure 14B:
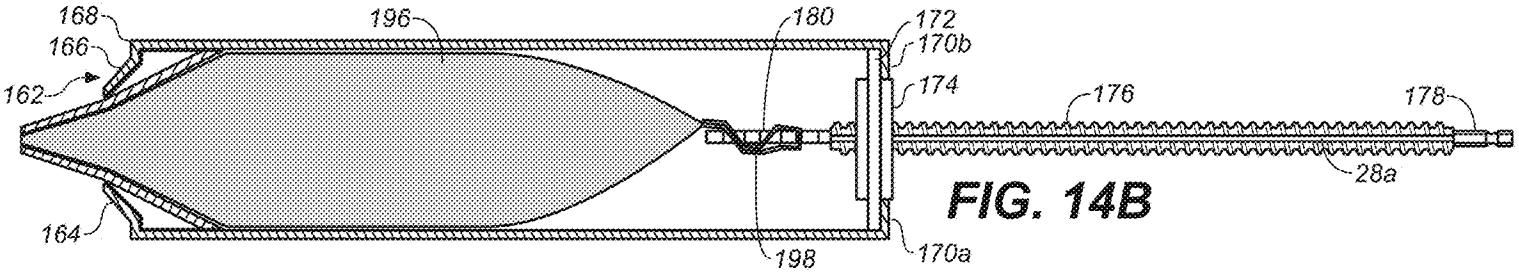
FIG. 14B shows the same bag with the drive screw and slotted plate turned 90 degrees.
Figure 14C:
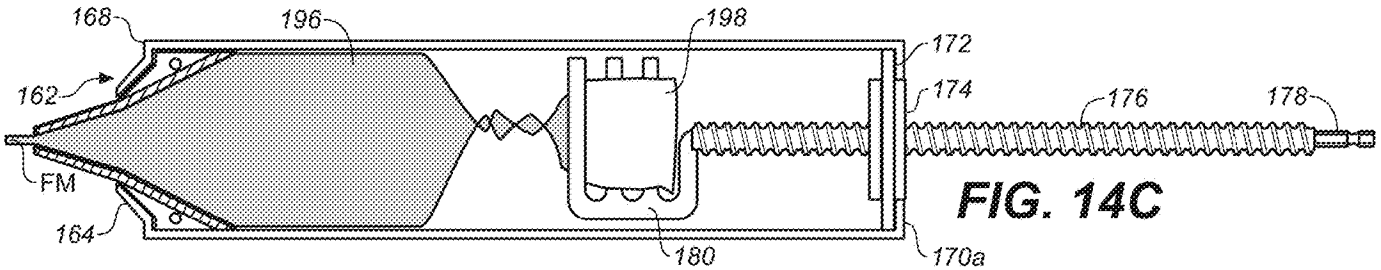
FIG. 14C shows the bag with the drive screw and slotted plate turned several full rotations so as to wring out a portion of the flowable material.
Figure 14D:
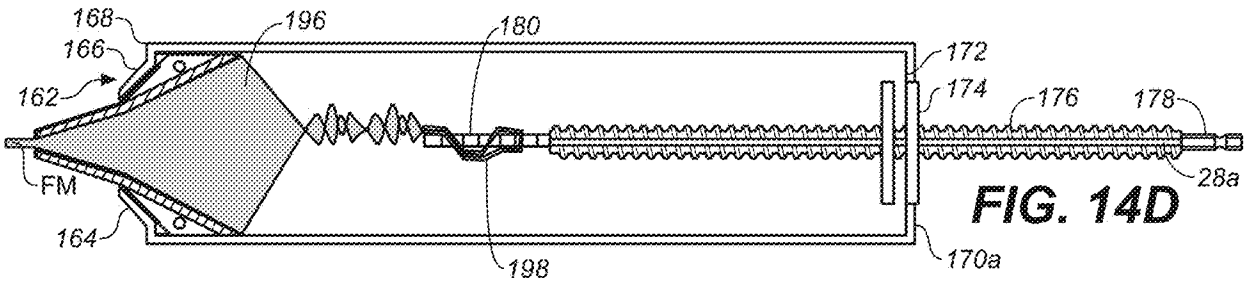
FIG. 14D shows the material bag further wrung out and nearly emptied.
Figure 14E:
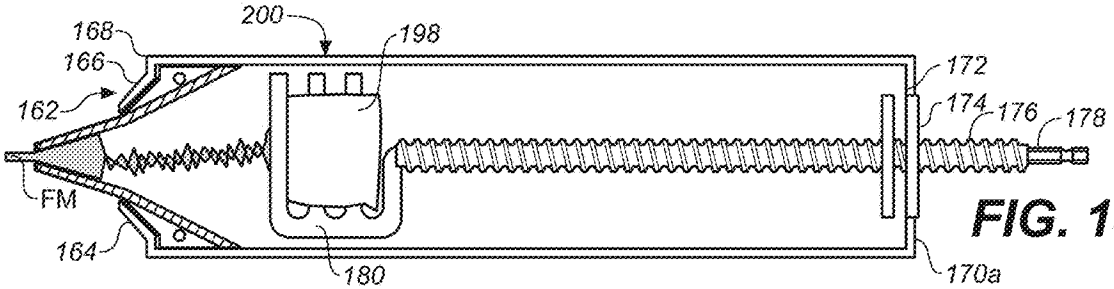
FIG. 14E shows the material bag still further wrung out.
Figure 14F:
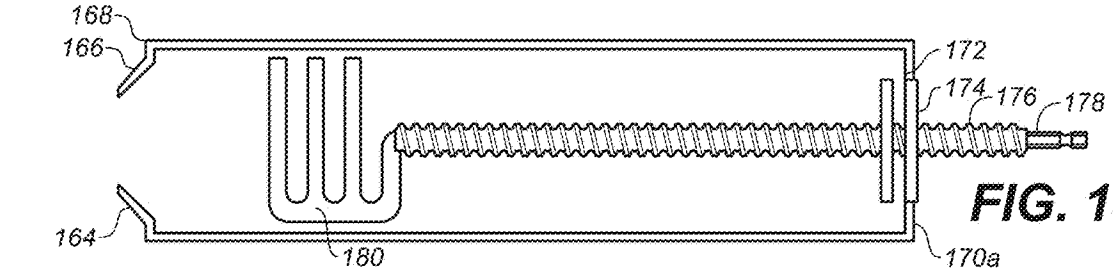
FIG. 14F shows the material bag substantially emptied by the wringing out operation of the dispenser.

Use of the combined alternative embodiments is shown in FIGS. 14A-14F. Complete discharge of the flowable material is shown in FIG. 14E, and removal of the emptied material bag (FIG. 14F) prepares the barrel for installation and discharge of another filled flowable material bag by spinning the threaded drive rod out to place the slotted plate at the rear of the barrel.

Figure 15B:
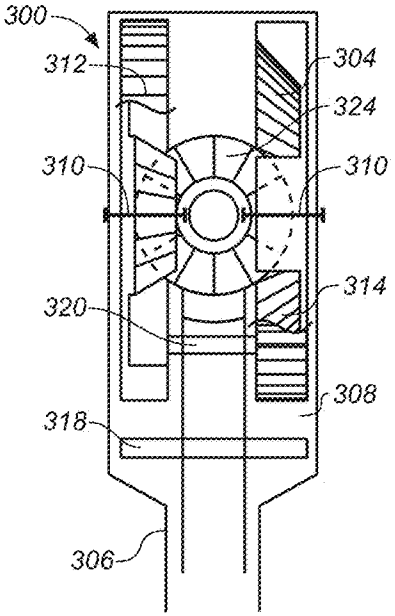
FIG. 15B is a front end view thereof.
Figure 15A:
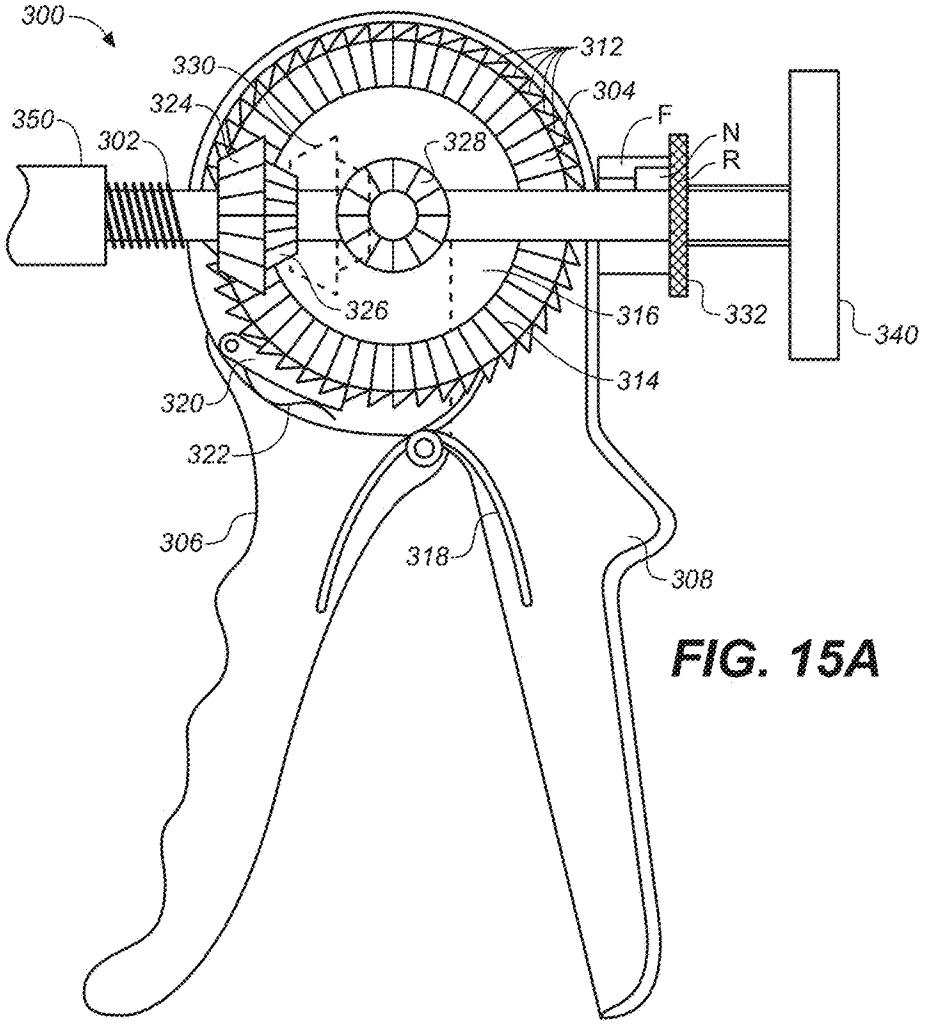
FIG. 15A is a cross-sectional side view in elevation of an embodiment using a pawl-and-ratchet mechanism to rotate and thus drive the drive screw reciprocally.

FIGS. 15A-B show an embodiment 300 in which reciprocal motion of the drive rod 302 is actuated by a combination bevel and spur gear 304 (termed a "ratchet gear" herein) which is rotated (in a counterclockwise direction in the orientation shown in the view) by a lever 306 pivotally coupled to a stationary handle portion 308 at an axis 310. The ratchet gear includes circumferential spur teeth 312 around its edge and peripheral bevel teeth 314 disposed on an inboard side wall 316 near the periphery of the gear. An embodiment uses a gear ratio of 4:1 (e.g., 48 teeth on the ratchet gear and 12 teeth on the drive rod gear). Thus, when lever 306 is pulled in an arc of approximately 30 degrees, 12 pulls of the lever are required to complete a full 360 degree rotation of the ratchet gear, but this is reduced by the 4:1 gear ratio such that each pull results in 120 degrees of rotation.

Lever 306 is urged into an open configuration by a spring 318. A pawl 320, pivotally affixed to the lever portion and biased by a spring 322 into engagement with the spur teeth of the bevel and gear, moves the bevel and spur gear in the single direction. The bevel teeth 314, which may be either straight, spiral, or hyphoid in shape, engage the complementary bevel teeth of a drive rod bevel gear 324. The drive rod bevel gear includes a reverse direction bevel gear portion 326 having teeth that engage the bevel teeth of a central bevel gear 328. The drive rod bevel gear can be selectively moved axially out of engagement with the peripheral bevel teeth 314 and either entirely out of engagement with a complementary bevel gear or into engagement with the central bevel gear 328, shown in phantom at 330. This is accomplished using a stepped collar 332. When disengaged and in a neutral position, the drive rod handle 340 can be freely turned in any direction. When the drive rod bevel gear 324 is pulled back into engagement with the center bevel gear 328, reverse rotation of the pronged paddle may be effected so as to bring the paddle into any desired position. As in the earlier described embodiments, the tension spring 302 is journaled in a center nut 350 on the gun barrel end.

It will be appreciated that a housing cover, not shown, may be provided to entirely enclose the gear assembly of this embodiment.

As noted above, the material bag may come pre-packaged or empty for mixing on site. However, the present invention provides distinct advantages for materials that require a liquid additive for activation and fluidity. The sleeve of the material bag can be open at the tail end, powdered material added, liquid and activation substances added, and the product mixed in the sleeve. The slotted plate allows a user to slip the folded empty tail end of the bag down onto the prongs and to pull slack out from the working end of the bag to help control how the bag expels the materials to be placed. For packaged, flowable materials that do not need to be mixed, the tail (wringer) end of the bag can have a broadened end seal, (possibly with pre-punched holes), for clamping to the end of the threaded rod. The pre-punched holes fit over studs on the clamp to more positively secure the correct positioning of the bag as it is wrung out. A simple hook may suffice for some kinds of bags and materials.

An additional advantage of the present invention derives from the fact that materials in polyethylene bags can be sterilized. This may add to the shelf life for some products and may even make some industrial foodstuffs suitable for dispensing with the apparatus of the present invention.

The foregoing may make clear that the wringer-type flowable material dispenser of the present invention is superior to piston expelled, cartridge packaged materials. This is because for material cartridges, a seal must be maintained between the plunger cup and the interior sides of the cartridge. No such requirement applies to the present invention.

The present invention is also suitable for use in dispensing two-part epoxy products. The resin and hardener, for example, can be disposed in a longitudinally oriented sectional bags mixed in the static nozzle portion of the gun barrel. It may also be used with burst pack materials configured for mixing in the field. This significantly expands the uses of the inventive apparatus beyond conventional grouts, adhesives and sealants.

Most advantageously, the flowable material dispenser of the present invention expels substantially all of the flowable material in the material bag. As the bag is wrung out and material expelled through the nozzle there is only a very small residual amount of material trapped in the folds or creases of the "wrung out" bag. There may be slightly more material left at the nozzle end of the bag that may not be expelled by the wringing motion of the drive rod, but the amount is insubstantial for all practical and economical purposes. Even this small amount can be expelled by hand relatively easily after removing the bag from the gun. The barrel portion of the dispenser may be provided with transparent portions or windows to enable the user to see the bag and whether its contents have been entirely discharged.

From the foregoing, it will be appreciated that in its most essential aspect, the present invention is a flowable material dispenser including a barrel defining a cylindrical interior volume, the barrel having a first end, a second end, and a closure mechanism for selectively opening and closing the barrel for placement of a flexible material bag containing a flowable material and removal of the bag when partially or fully emptied of the flowable material; a handle affixed to the barrel to facilitate handling by a user; a nozzle attached to the first end for discharging the flowable material through a nozzle hole; a closure disposed on the second end; a center nut disposed on the closure; a threaded drive rod threadably and rotatably inserted in the center nut, the drive rod having an inner end and an outer end; drive structure for imparting rotational forces to the drive rod so as to move the drive rod reciprocally and axially within the cylindrical interior volume of the barrel; and bag attachment structure for attachment to the flexible material bag; wherein when the drive rod is rotated in a discharge direction, the flexible material bag is twisted, thereby reducing its volume and forcing the flowable material through the nozzle hole.

The foregoing disclosure is sufficient to enable those with skill in the relevant art to practice the invention without undue experimentation. The disclosure further provides the best mode of practicing the invention now contemplated by the inventor.

While the particular apparatus and method herein shown and disclosed in detail is fully capable of attaining the objects and providing the advantages stated herein, it is to be understood that it is merely illustrative of the presently preferred embodiments of the invention and that no limitations are intended to the detail of construction or design herein shown other than as defined in the appended claims. Accordingly, the proper scope of the present invention should be determined only by the broadest interpretation of the appended claims so as to encompass all such modifications as well as all relationships equivalent to those illustrated in the drawings and described in the specification.

What is claimed as invention is:

1. A flowable material dispenser, comprising:

a barrel defining a cylindrical interior volume, said barrel having a front end, a rear end, and a closure mechanism for selectively opening and closing said barrel for placement of a flexible material bag containing a flowable material and removal of said bag when partially or fully emptied of the flowable material;

a nozzle attached to said front end for discharging the flowable material through a nozzle hole;

a rear end closure disposed on said rear end;

a center nut disposed on said rear end closure;

a threaded drive rod threadably and rotatably inserted in said center nut, said drive rod having an inner end and an outer end;

drive structure for imparting rotational forces to said drive rod so as to move said drive rod reciprocally and axially within said cylindrical interior volume of said barrel; and bag attachment structure for attachment to the flexible material bag;

wherein when said drive rod is rotated in a discharge direction, the flexible material bag is twisted, thereby reducing the bag's volume and forcing the flowable material through said nozzle hole.

2. The flowable material dispenser of claim 1, wherein said barrel includes a barrel body having a base portion, and said closure mechanism comprises a hinged panel door pivotally coupled to said base portion.

3. The flowable material dispenser of claim 2, wherein the pivotal coupling of said hinged panel to said base portion is accomplished with hinges secured by latches.

4. The flowable material dispenser of claim 1, further including a handle affixed to said barrel to facilitate handling by a user.

5. The flowable material dispenser of claim 1, wherein said rear end closure comprises first and second drive screw plates capturing said center nut.

6. The flowable material dispenser of claim 1, wherein said drive structure comprises a handle disposed on said outer end of said drive rod for manually rotating said drive rod.

7. The flowable material dispenser of claim 1, wherein said drive structure comprises a motor operatively coupled to said outer end of said drive rod.

8. The flowable material dispenser of claim 1, wherein said bag attachment structure comprises a bag attachment plate attached to said inner end.

9. The flowable material dispenser of claim 8, wherein said bag attachment plate includes a plurality of spaced apart slots as so enable a tail portion of a material bag to be threaded through said slots.

10. The flowable material dispenser of claim 1, wherein said nozzle is a split nozzle with semiconical halves that close with the closure mechanism to form a taper that terminates in said nozzle hole.

11. The flowable material dispenser of claim 10, wherein either of said nozzle or said front end of said barrel includes the bag attachment structure for securing and holding a front end of a flexible material bag to prevent the front end from twisting as the bag is wrung out during operation.

12. The flowable material dispenser of claim 11, wherein said bag attachment structure of said nozzle or said barrel comprises opposing hole elements and pin elements to capture a portion of the flowable material bag.

13. The flowable material dispenser of claim 12, wherein the flexible material bag has a front end and a rear end, said front end including a semi-rigid funnel form cone having attachment structure for attachment to bag attachment structure of said nozzle or said barrel.

14. The flowable material dispenser of claim 13, wherein said attachment structure on said flexible material bag comprises two perforated fins that cooperate with said hole elements and said pin elements in said nozzle or said barrel end.

15. The flowable material dispenser of claim 14, wherein said flexible material bag includes a flattened rear portion welded into a sealed flexible tail.

16. The flowable material dispenser of claim 11, wherein said flowable material bag is fabricated from polyethylene.

17. The flowable material dispenser of claim 1, wherein said drive structure comprises an electric motor having a drive pulley operatively coupled with a drive belt to a driven pulley threadably and axially disposed on said outer end of said drive rod, such that when said electric motor is operated, said drive pulley does not move reciprocally as the driven pulley is spun by said electric motor.

18. The flowable material dispenser of claim 1, wherein said drive structure is a pawl-and-ratchet assembly including:

a ratchet gear having both a bevel gear and a spur gear, said ratchet gear rotated by actuation of a lever pivotally coupled to a stationary handle portion at an axis, said ratchet gear including circumferential spur teeth around an edge and peripheral bevel teeth disposed on an inboard side wall proximate the periphery of the gear; a spring urging said lever into an open configuration;

a spring urging said lever into an open configuration;

a pawl pivotally affixed to said lever portion and biased by a spring into engagement with said spur teeth of said ratchet gear, wherein actuation of said lever moves said ratchet gear in a single direction to drive said inner end of said drive rod toward said front end of said barrel; and a drive rod bevel gear engaging said bevel teeth of said ratchet gear.

19. The flowable material dispenser of claim 18, wherein drive rod bevel gear includes a reverse direction bevel gear portion having teeth that engage the bevel teeth of a central bevel gear, and wherein said drive rod bevel gear can be selectively moved axially out of engagement with said peripheral bevel teeth of said ratchet gear and into engagement with the central bevel gear.

20. The flowable material dispenser of claim 19, wherein said drive rod bevel gear is moved into either a forward, neutral, or reverse drive position with a stepped collar slidably disposed on said outer end of said drive rod so as to move said drive rod bevel gear when manually pulled rearward or pushed forward.

* * * * *